US010994281B2

(12) United States Patent
Kozuka

(10) Patent No.: US 10,994,281 B2
(45) Date of Patent: May 4, 2021

(54) METHOD FOR SEPARATING PARTICLES, SEPARATION APPARATUS, AND SEPARATION SYSTEM

(71) Applicant: ARKRAY, Inc., Kyoto (JP)

(72) Inventor: Masahiro Kozuka, Kyoto (JP)

(73) Assignee: ARKRAY, Inc., Kyoto (JP)

( * ) Notice: Subject to any disclaimer, the term of this patent is extended or adjusted under 35 U.S.C. 154(b) by 14 days.

(21) Appl. No.: 15/720,548

(22) Filed: Sep. 29, 2017

(65) Prior Publication Data

US 2018/0093280 A1 Apr. 5, 2018

(30) Foreign Application Priority Data

Sep. 30, 2016 (JP) ..... JP2016-193802
Sep. 28, 2017 (JP) ..... JP2017-188914

(51) Int. Cl.
*B03C 1/28* (2006.01)
*B03C 1/01* (2006.01)

(52) U.S. Cl.
CPC ..... *B03C 1/288* (2013.01); *B03C 1/01* (2013.01); *B03C 2201/18* (2013.01); *B03C 2201/26* (2013.01)

(58) Field of Classification Search
CPC ..... B03C 1/01; B03C 1/288; B03C 2201/18; B03C 2201/26; G01N 35/00
See application file for complete search history.

(56) References Cited

U.S. PATENT DOCUMENTS 6,383,397 B1 5/2002 Kojima
8,083,068 B2 * 12/2011 Kaduchak ..... B03B 1/04 209/5
9,421,553 B2 * 8/2016 Dionne ..... B03B 5/00
2008/0302732 A1 * 12/2008 Soh ..... B01L 3/502761 210/695
2011/0059500 A1 * 3/2011 Wo ..... C12N 13/00 435/173.9
2011/0134426 A1 * 6/2011 Kaduchak ..... G01N 21/453 356/337
2012/0295302 A1 * 11/2012 Lamish ..... B03C 1/0335 435/39
2016/0244714 A1 * 8/2016 Spuhler ..... G01N 35/0098

FOREIGN PATENT DOCUMENTS

CN 1297379 A 5/2001
CN 106222161 A 12/2016
JP 2013-517763 A 5/2013
WO 2011/089603 A1 7/2011

OTHER PUBLICATIONS

Extended European Search Report issued in corresponding European Patent Application No. 17194241.0 dated Feb. 26, 2018.

* cited by examiner

*Primary Examiner* — Charles A Fox
*Assistant Examiner* — Kalyanavenkateshware Kumar
(74) *Attorney, Agent, or Firm* — Morgan, Lewis & Bockius LLP

(57) ABSTRACT

Provided is a method for separating particles, a separation apparatus, and a separation system.

18 Claims, 1 Drawing Sheet

METHOD FOR SEPARATING PARTICLES, SEPARATION APPARATUS, AND SEPARATION SYSTEM

BACKGROUND OF THE INVENTION

1. Field of the Invention

The present disclosure relates to a method for separating particles, a separation apparatus, and a separation system. In particular, the present disclosure relates to a method for separating labeled particles and non-labeled particles that are included in a suspension, and a separation apparatus and a separation system that are used therefor.

2. Description of Related Art

Methods for separating target particles from a suspension containing a plurality of types of particles include a method in which target particles are labeled with magnetism or the like in advance, and the target particles are separated from the other particles by removing the suspension liquid in a state in which the labeled target particles are attracted by a magnet or the like. A sample containing magnetically labeled cells may be introduced into a tube in which magnetic flux is generated. Here, adhesion of cells other than the magnetically labeled cells (not magnetically labeled cells) to the wall of the tube is suppressed while the magnetically labeled cells are attracted to the wall of the tube by the magnetic flux. Then, the sample in the tube is ejected to the outside, magnetic flux is stopped, and the magnetically labeled cells are separated from the wall of the tube. Finally, the target cells may be collected by washing with liquid, and thereby the target cells are separated and collected.

SUMMARY OF THE INVENTION

In one aspect, separation may be performed by labeling target particles (i.e., positive selection). With this method, the labeled target particles are captured by magnetism or the like, and in this state, separation is performed by removing non-labeled particles other than the labeled particles, and thereafter, the target particles are collected by releasing the capture with magnetism or the like.

However, if the number of target particles included in the sample is smaller than the number of particles other than the target particles, the above-described method has the problem of separation precision, and the separated target particles cannot be collected with the above-described method with sufficient precision in some cases.

In one or more embodiments, the present disclosure provides a method, a separation apparatus, and a separation system with which labeled particles and non-labeled particles are separated efficiently, and non-labeled particles may be highly precisely collected.

One aspect of the present disclosure is a method for separating labeled particles and non-labeled particles, and relates to the separation method including supplying a suspension containing labeled particles and non-labeled particles into a flow channel from one end of the flow channel, deflecting the labeled particles in the flow channel in a direction that is different from a gravity direction, fixing the labeled particles onto an inner wall surface of the flow channel, ejecting the suspension in the flow channel from another end of the flow channel by introducing a gas phase into the flow channel from one end of the flow channel in a state in which the labeled particles are fixed on the inner wall surface of the flow channel, and collecting the non-labeled particles.

One aspect of the present disclosure is an apparatus for separating labeled particles and non-labeled particles, and relates to the separation apparatus including a flow channel into which a suspension containing labeled particles and non-labeled particles may be supplied, a means for deflecting the labeled particles in a direction that is different from the gravity direction and fixing the labeled particles onto an inner wall surface of the flow channel, and an introduction means for introducing a gas phase for ejecting the suspension in the flow channel.

One aspect of the present disclosure is a system for separating labeled particles and non-labeled particles, and relates to the separation system including a separation portion, and an introduction means for introducing a gas phase in the flow channel, the separation portion includes a flow channel into which a suspension containing labeled particles and non-labeled particles may be supplied, and a means for deflecting the labeled particles in a direction that is different from the gravity direction and fixing the labeled particles onto an inner wall surface of the flow channel.

According to the present disclosure, in one aspect, labeled particles and non-labeled particles may be efficiently separated, and non-labeled particles are precisely collected.

DETAILED DESCRIPTION OF THE INVENTION

Figure 1:
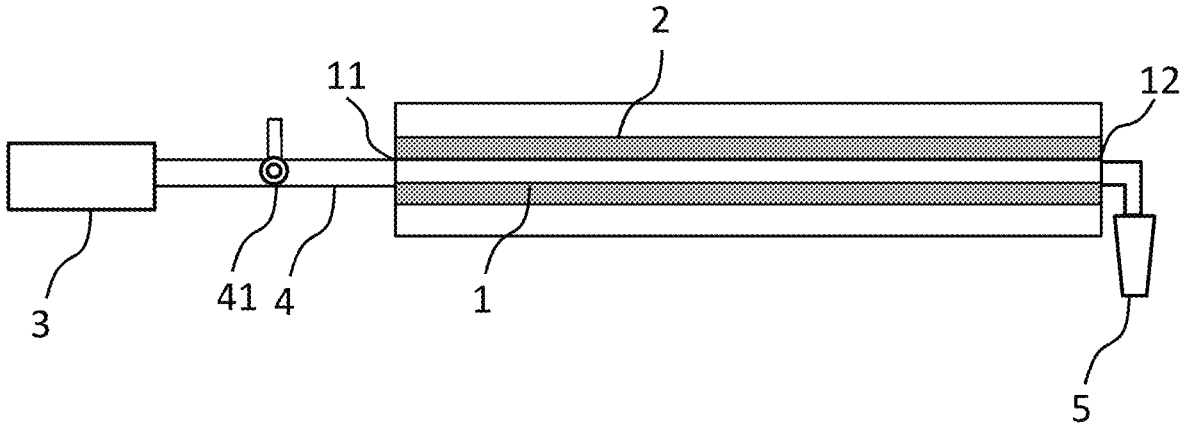
FIG. 1 is a schematic diagram showing one example of a separation apparatus that may be utilized in a separation method of the present disclosure.

In some embodiments, target cells are separated and collected by performing magnetic separation in a tube. A method for performing magnetic separation in a tube is advantageous in that the method is easily systematized or utilized in an apparatus due to having a flow channel structure, and the distance between a suspension containing labeled particles and magnetism may be reduced by reducing the inner diameter of the tube. In particular, if magnetism is used, the magnetic force is inversely proportional to the square of the distance, and thus it is extremely important to improve performance of magnetic separation by reducing the distance. However, this method has some issues.

First, it is difficult to efficiently collect cells that need to be collected from the tube. Regardless of positive selection or negative selection, particles that need to be collected aggregate on the wall of the tube due to the magnetic force, gravity, and the like. In order to collect particles aggregating on the wall, in general, liquid is sent into the tube, and the liquid flows through the center of the tube at a high speed, but the liquid does not easily flow on the wall surface of the tube and flows on the wall surface at an extremely slow speed. Thus, it is difficult to efficiently move cells on the wall surface by sending the liquid, as a result of which the recovery ratio of target particles decreases.

Second, it is difficult to maintain or reduce the amount of collected liquid after processing (e.g., separation) in the tube with respect to the amount of liquid before the processing (e.g., separation) in the tube, that is, the amount of collected liquid after separation processing tends to increase compared to the liquid amount before the processing, and thus this method is not suitable for handling rare particles.

An example of a means for compensating for poor efficiency of collecting particles that need to be collected, which is the first issue, is a means for collecting particles that were not collected by sending additional liquid. However, in this case, the amount of collected liquid after processing increases. When particles that are to be collected are rare particles, if the amount of collected liquid increases, then the concentration of particles is extremely low, and it is difficult to handle the particles. When rare particles are handled, it is desired to reduce the amount of collected liquid and handle a small amount of the rare particles, and thus this method is not suitable for handling rare particles. In some embodiments, the rare particles may be rare cells described herein.

In one aspect, in accordance with the disclosure herein, if a suspension that undergoes separation contains a small amount of target particles (i.e., particles to be detected), precision in separation and collection of particles to be detected may be increased by labeling and separating particles that are not to be detected.

Also, in one aspect, in accordance with the disclosure herein, precision in separation and collection of particles that are to be detected may be increased by moving the particles to be detected toward a bottom surface of a flow channel, and introducing a gas phase into the flow channel and collecting the suspension in the flow channel in a state in which particles that are not to be detected are captured by (fixed to) portions other than the bottom surface of the flow channel.

For example, when a gas phase is introduced into the flow channel in which the suspension containing particles to be detected is present, a gas-liquid interface may be formed in the flow channel. Furthermore, extrusion force is applied to the gas-liquid interface by introducing a gas phase, and the gas-liquid interface may move from the inlet side to the outlet side in the flow channel. Particles to be detected in the flow channel may be extruded together with the suspension due to movement of the gas-liquid interface, but particles that are not to be detected may be captured or fixed in the flow channel and thus are held without being extruded. Also, if particles that are not to be detected are captured by a wall surface of the flow channel that is different from that for particles to be detected, the particles that are not to be detected may not inhibit the particles to be detected from being extruded. Thus, the particles to be detected may be extruded smoothly. As a result, particles to be detected may be separated and collected with high precision. However, the present disclosure need not be interpreted as being limited to these mechanisms.

In general, 10 mL of blood contains only about 0 to 10 rare cells, such as circulating tumor cells (CTCs). According to the method of the present disclosure, in one or more embodiments, rare cells and white blood cells may be separated from a sample containing a larger amount of white blood cells than rare cells, and the rare cells may be collected with a high collection ratio. The number of CTCs in blood needs to be accurately analyzed since it is useful as a factor for determining the effect of treating a metastatic cancer or predicting prognosis of a metastatic cancer. Thus, in one or more embodiments, the method of the present disclosure is an extremely important technique in the determination of the effect of treatment and prognosis prediction in these fields.

Separation Method

In one aspect, the present disclosure relates to a method for separating labeled particles and non-labeled particles. The separation method of the present disclosure includes supplying a suspension containing labeled particles and non-labeled particles into a flow channel from one end of the flow channel, deflecting the labeled particles in the flow channel in a direction that is different from the gravity direction, fixing the labeled particles onto an inner wall surface of the flow channel, ejecting the suspension in the flow channel from another end of the flow channel by introducing a gas phase in the flow channel from one end of the flow channel in a state in which the labeled particles are fixed on the inner wall surface of the flow channel, and collecting and/or isolating the non-labeled particles. According to the separation method of the present disclosure, in one or more embodiments, it is possible to highly precisely separate labeled particles and non-labeled particles and to highly precisely collect non-labeled particles.

The separation method of the present disclosure includes supplying the suspension containing labeled particles and non-labeled particles into a flow channel from one end of the flow channel. Accordingly, the flow channel is filled with the suspension.

The flow channel has an inlet and an outlet in one or more embodiments. In one or more embodiments, the length in the longitudinal direction of the flow channel is about 80 cm or less, 60 cm or less, or 40 cm or less, and 2 cm or more, 5 cm or more, or 10 cm or more, from the viewpoint of reducing loss of non-labeled particles (target particles) in the flow channel. As used herein, the term "about" may refer to a range of values that are similar to the stated reference value. In certain embodiments, the term "about" refers to a range of values that fall within 15, 10, 9, 8, 7, 6, 5, 4, 3, 2, 1 percent or less of the stated reference value.

In one or more embodiments, the inner diameter of the flow channel is about 50 mm or less, 20 mm or less, or 10 mm or less, and 0.5 mm or more, 1 mm or more, or 2 mm or more, from the viewpoint of being capable of forming a stable gas-liquid interface and further increasing the precision in collection of non-labeled particles.

In one or more embodiments, the volume of the flow channel is about 10,000 μl or less, 5,000 μl or less, or 2,000 μm or less, and 10 μl or more, 50 μl or more, or 100 μl or more from the viewpoint of being capable of increasing the precision in collection of non-labeled particles.

In one or more embodiments, the cross-section that is orthogonal to the straight direction between the inlet and outlet (longitudinal direction of the flow channel) has a circular shape, an elliptical shape, a rectangular shape, a polygonal shape such as triangular, square, pentagonal, hexagonal, heptagonal, or octagonal shape, or the like. The cross section may have a circular or elliptical shape from the viewpoint of preventing loss of non-labeled particles (target particles) in the channel. In one or more embodiments, the flow channel has a hollow tubular shape, an approximately rectangular parallelepiped shape, a polygonal tubular shape, or the like.

In one or more embodiments, the flow channel may be disposed in a direction (approximately horizontal direction) that is orthogonal to the perpendicular direction (gravity direction).

In one or more embodiments of the separation method of the present disclosure, the non-labeled particles are particles to be detected (so called target particles) and the labeled particles are particles that are not to be detected. In one or more embodiments, the suspension contains a greater amount of labeled particles than non-labeled particles. In one or more embodiments, a ratio of the non-labeled particles with respect to the labeled particles in the suspension ([non-labeled particles]/[labeled particles]) is about 1% or less, 0.5% or less, 0.4% or less, 0.3% or less, 0.2% or less, 0.1% or less, or 0.09% or less. In one or more embodiments, a ratio of the non-labeled particles with respect to the labeled particles in the suspension ([non-labeled particles]/[labeled particles]) is about 0.5% or more, 0.4% or more, 0.3% or more, 0.2% or more, 0.1% or more, 0.09% or more, or 0.01% or more. In one or more embodiments, the separation method of the present disclosure is a useful technique in the case where non-labeled particles are separated and collected from a suspension that contains a larger amount of labeled particles than non-labeled particles.

In one or more embodiments, examples of the label on particles include a magnetic label, a metal label, and the like. In one or more embodiments, in the case of the magnetic label, particles may be labeled by particle binding molecules and substances fixed on surfaces of magnetic beads (substances that specifically react with binding molecules) binding with each other such that magnetic beads are fixed to the particles. In one or more embodiments, the substances fixed to the magnetic beads may be determined as appropriate in accordance with binding molecules of the particles to be labeled. In one or more embodiments, examples of the magnetic bead include a magnetic bead having a surface to which avidin is fixed, a magnetic bead having a surface to which streptavidin is fixed, a magnetic bead having a surface to which neutravidin is fixed, a magnetic bead having a surface to which biotin is fixed, a magnetic bead having a surface to which a biotin derivative is fixed, a magnetic bead having a surface to which antibody is fixed, and a magnetic bead having a surface to which an antigen is fixed. There is no particular limitation on the size of the magnetic bead, and the size of the magnetic bead may be determined as appropriate in accordance with the size of particles to be labeled. If the diameter of a particle to be labeled is about 5 to 20 μm, such as white blood cells or CTCs, in one or more embodiments, the size of the magnetic bead is about 1 μm or less, 800 μm or less, or 500 μm or less from the viewpoint of increasing the efficiency of labeling. Also, from the viewpoint of magnetic responsiveness, the size of the magnetic bead is about 50 μm or more or 100 μm or more.

In one or more embodiments, a suspension may be supplied in a state in which the other end of the flow channel (the end of the flow channel on the side opposite to the side on which a suspension is supplied) is closed. In one or more embodiments, approximately the entire amount of the suspension supplied into the flow channel fills the flow channel. From the viewpoint of smoothly filling the flow channel with the suspension, the suspension may be supplied in a state in which no magnetic field or electric field is formed in the flow channel.

In one or more embodiments, the amount of the suspension that is supplied to the flow channel is about 10,000 μl or less, 5,000 μl or less, or 2,000 μm or less, and 10 μl or more, 50 μl or more, or 100 μl or more from the viewpoint of being capable of increasing the precision in collection of non-labeled particles.

In one or more embodiments, the separation method of the present disclosure may include letting the suspension with which the flow channel is filled stand still. Accordingly, non-labeled particles may be moved toward the bottom surface of the flow channel by utilizing gravity or the like that acts on these particles. In one or more embodiments, from the viewpoint of the cell settling speed and efficient magnetic separation, the standing period of time is about 1 min or more, 5 min or more, or 10 min or more, and 60 min or less or 30 min or less.

The separation method of the present disclosure includes deflecting labeled particles in a direction that is different from the gravity direction in the flow channel.

In one or more embodiments, deflection may be performed by forming a magnetic field or an electric field in the flow channel. In one or more embodiments, the magnetic field or the electric field may be formed over the entire length in the longitudinal direction of the flow channel or formed in a portion of the flow channel.

In one or more embodiments, the labeled particles may be deflected in a direction that is different from the direction in which the non-labeled particles are deflected, that is, the labeled particles may be deflected in a direction that is different from the gravity direction by moving the non-labeled particles toward the bottom surface of the flow channel and moving the labeled particles to portions other than the bottom surface of the flow channel. In one or more embodiments, the magnetic field may be formed by arranging a magnetic field emission body in the flow channel, or the like. The arrangement location may be determined as appropriate in accordance with the direction in which the labeled particles are to be deflected, and if the labeled particles are to be moved to the portions other than the bottom surface of the flow channel, in one or more embodiments, the magnetic field emission body need only be arranged in at least one of the upper portion and the side surfaces of the flow channel, and the magnetic field emission body may be arranged in one or both of the side surfaces because the labeled particles may be deflected with a weaker magnetic field compared to the case where the magnetic field emission body is arranged on the upper surface of the flow channel. In one or more embodiments, the magnetic field emission body may be arranged extending over the longitudinal direction of the flow channel, or may be arranged in at least a portion in the longitudinal direction of the flow channel. In one or more embodiments, the number of magnetic field emission bodies may be one, or two or more. In one or more embodiments, examples of the magnetic field emission body include a magnet and an electromagnet.

In one or more embodiments, the separation method of the present disclosure includes moving non-labeled particles toward the bottom surface of the flow channel by letting a suspension containing labeled particles and non-labeled particles stand still in the flow channel and utilizing the gravity acting on the non-labeled particles, and moving the labeled particles to portions other than the bottom surface of the flow channel by forming a magnetic field or an electric field in the flow channel.

The separation method of the present disclosure includes fixing the deflected labeled particles onto the inner wall surface of the flow channel.

Fixing may be determined as appropriate with the method for labeling labeled particles. If the labeled particles are magnetically labeled particles, fixing may be performed by forming a magnetic field in the flow channel.

In one or more embodiments in the separation method of the present disclosure, the resting of the suspension and the deflection and fixing of labeled particles may be performed simultaneously, or at different times.

In one or more embodiments, the separation method of the present disclosure includes ejecting the suspension in the flow channel from the other end of the flow channel by introducing a gas phase into the flow channel from one end of the flow channel in a state in which labeled particles are fixed on the inner wall surface of the flow channel, and collecting non-labeled particles. Particles may be efficiently collected by ejecting the suspension by movement of the gas-liquid interface caused by introducing the gas phase and pushing the non-labeled particles in the flow channel. Also, introducing the gas phase makes it possible to adjust the liquid amount at the time of particle collection to be equivalent to or less than the amount of the suspension before separation.

"Gas phase" in the present disclosure refers to a phase constituted by gas. In one or more embodiments, the gas phase may be introduced so as to eject the suspension in the flow channel together with non-labeled particles with pressure of the introduced gas phase from the other end of the flow channel. In one or more embodiments, the gas phase may be introduced so as to form a gas-liquid interface between the suspension in the suspension and the introduced gas phase, and so as to move this gas-liquid interface from one end (e.g., inlet) of the flow channel toward the other end (e.g., outlet). In one or more embodiments, the gas phase introduced in the present disclosure may occupy a certain region, which is not a point or line, of the inner wall surface of the flow channel, and if the gas phase has such a form, it is different from bubbles. Also, points at which the gas-liquid interface that is formed by introducing a gas phase and the inner wall surface of the flow channel are in contact with each other form a continuous line in one or more embodiments. In one or more embodiments, air, oxygen, nitrogen, argon, carbon dioxide, or the like may be used as gas.

In one or more embodiments, the gas phase may be introduced by a pressure generation mechanism or the like that is arranged at one end of the flow channel. In one or more embodiments, examples of the pressure generation mechanism include a syringe pump, a tube pump, and a vacuum pump.

From the viewpoint of the fact that a stable gas-liquid interface may be formed and precision in collection of non-labeled particles may be increased, and the fact that labeled particles that are fixed onto an inner wall surface in the flow channel are kept fixed thereon, in one or more embodiments, the flow rate of the gas phase is about 25 μl/min or more, 50 μl/min or more, or 75 μl/min or more, and 500 μl/min or less or 250 μl/min or less.

In one or more embodiments, the total amount of the suspension in the flow channel may be ejected or at least a portion of the suspension may be ejected. In one or more embodiments, ejecting a portion of the suspension in the flow channel makes it possible to collect non-labeled particles in a concentrated state.

In one or more embodiments, the separation method of the present disclosure may include collecting labeled particles by releasing fixation of labeled particles and introducing liquid into the flow channel.

In some embodiments, the suspension described herein may be a sample obtained from a human, patient or animal. In some embodiments, the sample may be blood, plasma, saliva or serum and/or may be derived from blood, plasma, saliva or serum. In additional embodiments, the sample contains the particles described herein. There are no particular limitations on the particles in the present disclosure, and examples thereof include human cells or cells of an animal other than a human. Examples of cells on which there are no particular limitation include rare cells, white blood cells, red blood cells, platelets, and undifferentiated cells thereof. The rare cells refer to cells other than blood cells (e.g., red blood cells, white blood cells, and platelets) that may be included in human blood or the blood of an animal other than a human. In one or more embodiments, examples of rare cells include cells selected from the group of cancer cells, circulatory tumor cells, vascular endothelial cells, vascular endothelial progenitor cells, cancer stem cells, epithelial cells, hematopoietic stem cells, mesenchymal stem cells, fetal cells, stem cells, undifferentiated white blood cells, undifferentiated red blood cells, and combinations thereof. In some embodiments, the labeled particles may be non-target particles (particles that are not to be detected, and the non-labeled particles may be target particles. In some embodiments, the target particles may be rare cells, and the non-target particles may be white blood cells.

Separation Apparatus

In one aspect, the present disclosure relates to an apparatus for separating labeled particles and non-labeled particles. The separation apparatus of the present disclosure includes a flow channel into which a suspension containing labeled particles and non-labeled particles may be supplied, a means for deflecting labeled particles in a direction that is different from the gravity direction, and fixing the labeled particles onto an inner wall surface of the flow channel, and an introduction means for introducing a gas phase for ejecting the suspension in the flow channel. According to the separation apparatus of the present disclosure, in one or more embodiments, it is possible to highly precisely separate labeled particles and non-labeled particles and to highly precisely collect non-labeled particles.

The flow channel has the configuration described above. The introduction means includes the above-described pressure generation mechanism and the like. The means for deflecting the labeled particles in the direction that is different from a direction in which the non-labeled particles are deflected, that is, in a direction that is different from the gravity direction, and fixing the labeled particles onto the inner wall surface of the flow channel may be a means capable of both deflecting and fixing particles or may be separate means including a deflection means and a fixing means, in one or more embodiments. In one or more embodiments, the means capable of both deflecting and fixing the labeled particles includes a magnetic field emission body and the like.

Separation System

In one aspect, the present disclosure relates to a system for separating labeled particles and non-labeled particles. The separation system of the present disclosure is constituted by a separation portion, and an introduction means for introducing a gas phase for ejecting the suspension in the flow channel. The separation portion is constituted by a flow channel into which a suspension containing labeled particles and non-labeled particles may be supplied, and a means for deflecting labeled particles in a direction that is different from a direction in which non-labeled particles are deflected, that is, in a direction that is different from the gravity direction and for fixing labeled particles onto an inner wall surface of the flow channel. According to the separation system of the present disclosure, in one or more embodiments, it is possible to highly precisely separate labeled particles and non-labeled particles, and to highly precisely collect non-labeled particles.

Another Aspect

In another aspect, the present disclosure relates to a method for separating target particles from the analyte containing a greater amount of non-target particles than the target particles. The separation method of this aspect includes labeling the non-target particles in the analyte; and capturing the labeled non-target particles, thereby separating the target particles and the non-target particles. In some embodiments, the analyte described herein may be a sample obtained from a human, patient or animal. In some embodiments, the analyte may be blood, plasma, saliva or serum.

Hereinafter, one non-limited embodiment of the separation method of the present disclosure will be described.

A case where a separation apparatus shown in FIG. 1 is used, and the non-labeled particles, such as target particles, are CTCs and the labeled particles are magnetically labeled white blood cells will be described as an example. The suspension contains a greater amount of magnetically labeled white blood cells than not magnetically labeled particles (e.g., CTCs). The present disclosure is not limited to this embodiment.

FIG. 1 shows one example of a separation apparatus that may be utilized in the separation method of the present disclosure.

Figure 2:
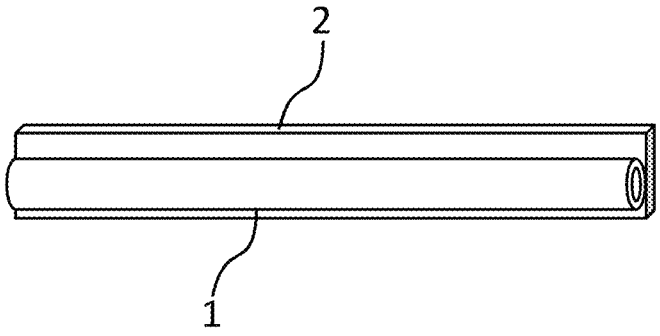
FIG. 2 is an illustrative diagram showing one example of an arrangement of a flow channel and a magnetic field emission body in the separation apparatus in FIG. 1.

The exemplary separation apparatus shown in FIG. 1 includes a flow channel 1, a magnetic field emission body 2, a gas phase introduction means (pressure generation mechanism) 3, and a tube 4 that connects the flow channel 1 and the gas phase introduction means 3. The flow channel 1 includes an inlet 11 and an outlet 12, and a collection container 5 may be disposed at the outlet 12. The flow channel 1 is disposed such that the central axis in the longitudinal direction is approximately horizontal. FIG. 2 shows one example of an arrangement of the flow channel 1 and the magnetic field emission body 2 in the separation apparatus in FIG. 1. As shown in FIG. 2, the magnetic field emission body 2 is disposed along the longitudinal direction on one side surface of the flow channel 1 disposed in an approximately horizontal direction. The tube 4 is provided with a three-way valve 41, and the suspension may be introduced into the flow channel 1 via the three-way valve 41.

Next, one example of a method for separating non-labeled particles and labeled particles using the separation apparatus in FIG. 1 will be described.

First, a suspension containing CTCs and magnetically labeled white blood cells is supplied into the flow channel 1 from the three-way valve 41 through the inlet 11, and the flow channel 1 is filled therewith. From the viewpoint of smoothly filling the flow channel 1 with the suspension, filling with the suspension may be performed in a state in which a magnetic field is not formed. White blood cells may be magnetically labeled by reaction with magnetic beads to which a substance that specifically reacts with binding molecules is fixed after white blood cells are subjected to antibody staining with an antibody or the like bound to these binding molecules. In one or more embodiments, the binding molecule is biotin or the like. In one or more embodiments, the specifically reacting substance includes proteins such as streptavidin and neutravidin.

After the end of filling, the suspension is allowed to stand still in the flow channel 1, and a magnetic field is formed in the flow channel 1 by the magnetic field emission body 2 disposed on the one side surface of the flow channel 1. Accordingly, magnetically labeled white blood cells are deflected and move toward an inner wall surface of the flow channel 1 on the side on which the magnetic field emission body 2 is disposed, and are captured by (fixed to) the inner wall surface (inner wall other than the bottom surface of the flow channel 1). On the other hand, non-labeled particles (e.g., CTCs) are not influenced by the magnetic field, and thus move toward the bottom surface of the flow channel 1 due to gravity.

A gas phase is introduced from the gas phase introduction means 3 into the flow channel 1 through the tube 4 and the inlet 11 in a state in which CTCs are located on the bottom surface of the flow channel 1 and magnetically labeled white blood cells are captured by the inner wall other than the bottom surface of the flow channel 1. The gas phase need only be introduced such that the suspension and non-labeled particles (e.g., CTCs) in the flow channel 1 may be ejected to the outside of the flow channel 1 and a state is maintained in which white blood cells captured by the inner wall other than the bottom surface of the flow channel 1 are captured inside the flow channel 1. The suspension containing CTCs ejected to the outside of the flow channel 1 is collected through the outlet 12 in the collection container 5 such as a tube. Accordingly, it is possible to separate non-labeled particles (e.g., CTCs) and magnetically labeled white blood cells and to collect non-labeled particles (e.g., CTCs). Particles may be efficiently collected by ejecting the suspension by movement of the gas-liquid interface caused by introducing a gas phase and pushing the non-labeled particles in the flow channel. Also, particles may be collected by introducing a gas phase, without increasing the liquid amount of white blood cells before and after separation. Also, CTCs may be collected in a concentrated state by adjusting the amount of the suspension that is ejected to the outside of the flow channel 1.

Although a mode in which the suspension and the gas phase are both introduced from the inlet 11 was described as an example in the above-described embodiment, the present disclosure is not limited to this, and the direction in which the suspension is introduced and the direction in which the gas phase is introduced may be different from each other. For example, a configuration may be adopted in which the suspension is introduced from the inlet 11 and the gas phase is introduced from the outlet 12.

Also, although a mode in which a magnetic field is formed in the flow channel 1 after the flow channel 1 is filled with the suspension was described as an example in the above-described embodiment, the present disclosure is not limited to this. A configuration may be adopted in which the flow channel 1 is filled with the suspension in a state in which the magnetic field is formed in the flow channel 1, and the filling with the suspension and the deflection of a direction in which labeled particles move are performed simultaneously.

Although a mode in which the magnetic field emission body 2 is disposed on one side surface of the flow channel 1 was described as an example in the above-described embodiment, the present disclosure is not limited to this. Since non-labeled particles move toward the bottom surface of the flow channel 1 due to gravity, from the viewpoint of keeping not magnetically labeled particles from being caught in and captured by magnetically labeled particles and increasing the ratio of collecting not magnetically labeled particles, it is desired to dispose the magnetic field emission body 2 at a position other than positions on the bottom surface. Also, labeled particles may be deflected with a relatively weak magnetic field compared to a case where the magnetic field emission body 2 is disposed on the upper surface of the flow channel 1, and thus the magnetic field emission body 2 may be disposed on the side surface of the flow channel 1.

The present disclosure relates to one or more embodiments below.

[1] A method for separating labeled particles and non-labeled particles, comprising:

supplying a suspension containing labeled particles and non-labeled particles into a flow channel from one end of the flow channel;

deflecting the labeled particles in the flow channel in a direction that is different from a gravity direction;

fixing the labeled particles onto an inner wall surface of the flow channel; and ejecting the suspension in the flow channel from another end of the flow channel by introducing a gas phase into the flow channel from one end of the flow channel in a state in which the labeled particles are fixed on the inner wall surface of the flow channel, and collecting the non-labeled particles.

[2] The separation method according to [1], in which the labeled particles are magnetically labeled particles.

[3] The separation method according to [1] or [2], in which the deflecting is performed by forming a magnetic field or an electric field in the flow channel.

[4] The separation method according to any of [1] to [3], in which the fixing is performed by forming a magnetic field in the flow channel.

[5] The separation method according to any of [1] to [4], in which the suspension contains a greater amount of the labeled particles than the non-labeled particles.

[6] An apparatus for separating labeled particles and non-labeled particles, comprising:

a flow channel into which a suspension containing labeled particles and non-labeled particles may be supplied;

a means for deflecting the labeled particles in a direction that is different from a gravity direction, and fixing the labeled particles onto an inner wall surface of the flow channel; and an introduction means for introducing a gas phase for ejecting the suspension in the flow channel.

[7] A system for separating labeled particles and non-labeled particles, comprising:

a separation portion; and an introduction means for introducing a gas phase in the flow channel, wherein the separation portion comprises:

a flow channel into which a suspension containing labeled particles and non-labeled particles may be supplied; and a means for deflecting the labeled particles in a direction that is different from a gravity direction, and fixing the labeled particles onto an inner wall surface of the flow channel.

EXAMPLES

Hereinafter, the present disclosure will be further described using Examples. In the following Examples, labeled particles (labeled white blood cells with magnetic particles) are deflected by a magnetic field, but may be deflected by an electric field using an electric wire or the like to which voltage is applied. However, the present disclosure is not to be construed as limited to the following examples.

Example 1

Separation and collection with the magnetic separation apparatus shown in FIG. 1 were performed using a suspension containing white blood cells that were labeled with magnetic particles and human colon adenocarcinoma cells.

Magnetic Separation Apparatus

The magnetic separation apparatus shown in FIG. 1 was prepared.

A syringe pump was connected to one end of a Safeed (trademark) tube (having an inner diameter of 3.1 mm, a tube length of 26 cm, and a volume of 2 $cm^3$) via a three-way valve and a syringe (10 mL), and a container for collecting liquid ejected from the Safeed (trademark) tube was disposed at the other end. A magnet (neodymium magnet (N40, square shape, 200×15×5 (mm), 5 mm magnetization direction, a surface magnetic flux density of 229 mT)) was disposed on a side surface of the Safeed (trademark) tube.

Preparation of Cell Suspension

A cell suspension was prepared by separately staining white blood cells (WBCs) and human colon adenocarcinoma cells that were collected from whole blood, adjusting the number of cells, and then mixing magnetic particles and both cells (white blood cells and human colon adenocarcinoma cells) so as to label white blood cells with magnetic particles. White blood cells are labeled with biotin, and magnetic particles coated with streptavidin are used, and thereby the magnetic particles specifically bind to white blood cells by mixing described above and only white blood cells are magnetically labeled. Specifically, the preparation of cell suspension was performed as follows.

Preparation of White Blood Cells

Blood was collected from a human using a vacuum blood collection tube (with EDTA·2K). White blood cells were separated from the collected whole blood in accordance with the package insert of HetaSep (STEMCELL Inc.).

Preparation of Cancer Cells

Cultured human colon adenocarcinoma cells strains (SW620 American Type Culture Collection (ATCC)) were collected using trypsin (Invitrogen) in accordance with a usual method. The suspension of the collected cancer cells was centrifuged to remove a supernatant. The cells were resuspended with a Dulbecco's PBS (−) (NISSUI), and the resulting suspension was centrifuged to remove a supernatant again, and then cancer cells (SW620) were obtained.

Labeling White Blood Cells with Biotin and Staining White Blood Cells

The number of cells was counted using a hemacytometer using a usual method, and white blood cells that were separated with HetaSep were fractionated, and a sample containing $10^5$ to $10^6$ white blood cells (cell suspension) was prepared. The sample was centrifuged to remove a supernatant, and then reacted with a blocking liquid obtained by dissolving a 10% goat serum, 0.000001% Avidin, 0.2% BSA in the Dulbecco's PBS (−), at 23° C. for 10 minutes. The sample was centrifuged to remove a supernatant, and resuspended using the Dulbecco's PBS (−). The sample was centrifuged again to remove a supernatant. Cells were suspended with a primary antibody reaction liquid obtained by adding an anti-CD45 antibody and an anti-CD50 antibody to a Dulbecco's PBS (−) that was obtained by dissolving a 10% goat serum, 0.01% Biotin, and 0.2% BSA in accordance with package insert, and reacted at 23° C. for 15 minutes. The sample was centrifuged to remove a supernatant, and resuspended using the Dulbecco's PBS (−). The step of centrifugation to remove a supernatant again was performed three times in total and cells were washed sufficiently. Cells were suspended with a secondary antibody reaction liquid obtained by adding an Alexa594 labeled anti-mouse IgG (Fab) and a Biotin labeled anti-mouse IgG(Fc) to a Dulbecco's PBS (−) that was obtained by dissolving 2 μg/ml Hoechst33342, a 10% goat serum, and 0.2% BSA in accordance with the package insert, and reacted at 23° C. for 15 minutes. The sample was centrifuged to remove a supernatant, and resuspended using the Dulbecco's PBS (−). A step of centrifugation to remove a supernatant again was performed three times in total and cells were washed sufficiently.

Staining of Cancer Cells

The obtained SW620 was suspended in a reaction liquid to which NeuroDio (green label) was added in accordance with the package insert, and reacted at 23° C. for 10 minutes.

The sample was centrifuged to remove a supernatant, and resuspended using the Dulbecco's PBS (−). The step of centrifugation to remove a supernatant again was performed three times in total and cells were washed sufficiently.

Magnetic Label

Magnetic particles (Bio-Adembeads StreptaDivin, having a particle diameter of 300 nm: Ademtech) suspended in a Dulbecco's PBS (−) obtained by dissolving 0.2% BSA were prepared in accordance with the package insert, NeuroDio-stained SW620 and Biotin labeled white blood cells were mixed therewith and reacted for 30 minutes. The suspension was passed through a filter having pores that have a short axial diameter of 5 μm and a long axial diameter of 88 μm so as to remove unreacted excess magnetic particles. The Dulbecco's PBS (−) obtained by dissolving 0.2% BSA was sent, and cells on the filter were collected to obtain a cell suspension.

Separation Method

1000 μL of the cell suspension was introduced through the three-way valve (three-way stopcock valve) to the Safeed (trademark) tube in a gas phase state that does not include a liquid phase and is filled with air, and a liquid phase constituted by a cell suspension was constructed in the Safeed (trademark) tube. A region extending from a syringe pump to an interface at the end of the cell suspension was made a continuous gas phase by closing an introduction inlet into which the cell suspension was introduced. Thereafter, a neodymium magnet (N40, square, 200×15×5 (mm), 5 mm magnetization direction) was moved to a position that was adjacent to the side surface of the Safeed (trademark) tube, and allowed to stand still at room temperature for 15 minutes. Air was introduced from the syringe pump into the Safeed (trademark) tube at a flow rate of 100 μl/min, and the entire liquid in the Safeed (trademark) tube was ejected from the Safeed (trademark) tube, and the ejected liquid was collected in the tube. White blood cells and SW620 included in the liquid that was collected in the tube were detected with fluorescence. The results are shown in Table 1.

The formation of the gas phase and introduction of air as described above make it possible to form a gas-liquid interface between the introduced gas phase and the suspension in the flow channel, and to move this gas-liquid interface from the inlet toward the outlet. As described above, this gas phase is continuous from the syringe pump to the interface at the end of the suspension, and this gas phase occupies a constant region that is not a point or line, on the inner wall of the flow channel. Also, points at which the gas-liquid interface and the inner wall surface of the flow channel are in contact with each other form a continuous line.

Comparative Example 1

1000 μL of the cell suspension that was used in Example 1 was added to a 1.5 mL tube. The cell suspension was allowed to stand still in a Magical Trapper (produced by TOYOBO) magnet stand at room temperature for 15 minutes. Next, the total amount of a supernatant was collected with a pipette. White blood cells and SW620 included in the collected supernatant were measured. The results are shown in Table 1.

Comparative Example 2

Magnetic separation was performed similarly to Example 1 except that a neodymium magnet was not used. The results are shown in Table 1.

Comparative Example 3

Magnet separation was performed similarly to Example 1 except that a Dulbecco's PBS (−) obtained by dissolving 0.2% BSA instead of air was sent at a flow rate of 100 μl/min. The results are shown in Table 1.

Comparative Example 4

Magnet separation was performed similarly to Example 1 except that a Dulbecco's PBS (−) obtained by dissolving 0.2% BSA instead of air was sent at a flow rate of 1000 μl/min. The results are shown in Table 1.

TABLE 1

| | Collection ratio (%) | |
|---|---|---|
| | SW620 | WBC |
| Example 1 | 88 | 0.1 |
| Comp. Ex. 1 | 90 | 4 |
| Comp. Ex. 2 | 84 | 33 |
| Comp. Ex. 3 | 0 | 0 |
| Comp. Ex. 4 | 12 | 0 |

As shown in Table 1, according to Example 1, it was confirmed that labeled particles (WBCs) and non-labeled particles (SW620) were separated effectively and target cells (SW620) were collected with a high collection ratio.

As shown in Table 1, in Comparative Example 2 in which a neodymium magnet was not used, a large amount of WBCs were ejected from the Safeed (trademark) tube and thus cells were not separated sufficiently. In Comparative Example 3 in which target cells were collected using the liquid (a liquid phase) at a flow rate that was equal to that in Example 1, instead of air (a gas phase), neither SW620 nor WBCs were collected at all. It is conceivable that the reason for this is an insufficient effect of pushing cells that settled in the flow channel due to their weight, with this flow rate, because although the liquid was sent at the same flow rate as air (gas phase), in the case of the liquid, a high flow velocity occurred only at the center of the flow channel but a flow velocity did not easily occur on the wall surface. Also, in Comparative Example 4 in which liquid was sent at a flow rate (1000 μl/min) disclosed in Example of JP 2013-517763A and cells were collected, WBCs were not collected at all, but the collection ratio of SW620 was as extremely low as 12% and SW620 (non-labeled particles) were not collected sufficiently.

Example 2

Magnetic separation was performed similarly to Example 1 except that the liquid that was ejected from the Safeed (trademark) tube was collected 100 μl at a time ten times. A fraction number was assigned to every 100 μL in the collected order, and the number of SW620s included in each fraction was measured. The results are shown in Table 2.

TABLE 2

| | Fraction # | | | | | | | | | | Total collected |
|---|---|---|---|---|---|---|---|---|---|---|---|
| | 1 | 2 | 3 | 4 | 5 | 6 | 7 | 8 | 9 | 10 | number |
| SW620 | 19 | 7 | 2 | 2 | 3 | 8 | 17 | 82 | 81 | 112 | 333 |

The collection ratio of SW620 in all of the fractions (the total of Fractions 1 to 10) was 88%, and the collection ratio (remaining ratio) of white blood cells was 0.097%. Accordingly, it was confirmed that collection target cells (i.e., rare cells) were effectively collected by introducing a gas phase (i.e., air) in a state in which cells (i.e., white blood cells) other than the collection target cells were held by a magnet.

Also, as shown in Table 2, 80% or more of the rare cells collected in this example were included in the last three fractions. Thus, it was shown that by fractionating liquid to be ejected or collecting only the latter half of the liquid, condensation is possible while collection target cells (i.e., rare cells) and cells (i.e., white blood cells) other than the collection target cells were separated.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method for separating labeled particles and non-labeled particles, comprising:

supplying a suspension comprising labeled particles and non-labeled particles into a flow channel from one end of the flow channel, the flow channel being disposed in a direction crossing gravity direction;

letting the supplied suspension stand still in the flow channel, and then deflecting the labeled particles in the flow channel in a direction that is different from a gravity direction;

fixing the deflected labeled particles onto an inner wall surface of the flow channel; and introducing a gas phase into the flow channel from one end of the flow channel to eject the suspension in the flow channel from another end of the flow channel while the labeled particles are fixed on the inner wall surface of the flow channel, thereby separating the labeled particles and the non-labeled particles.

2. The method according to claim 1, wherein the labeled particles are magnetically labeled particles.

3. The method according to claim 1, wherein the deflecting comprises forming a magnetic field or an electric field in the flow channel.

4. The method according to claim 1, wherein the fixing comprises forming a magnetic field in the flow channel.

5. The method according to claim 1, wherein the deflecting comprises forming a magnetic field or an electric field in the flow channel, and the fixing comprises forming a magnetic field in the flow channel.

6. The method according to claim 1, wherein the suspension comprises a greater amount of the labeled particles than the non-labeled particles.

7. The method according to claim 6, wherein the ratio of non-labeled particles to labeled particles in the suspension is 1% or less.

8. The method according to claim 1, further comprising collecting the non-labeled particles.

9. The separation method according to claim 1 wherein the particles are human or animal cells.

10. The method according to claim 1, wherein the non-labeled particles are target cells.

11. The method according to claim 1, wherein the labeled particles are labeled white blood cells, and the non-labeled particles are cancer cells.

12. The method according to claim 1, wherein the gas phase consists of one or more gas selected from the group consisting of air, oxygen, nitrogen, argon, and carbon dioxide.

13. The method according to claim 1, wherein the suspension is derived from a human blood sample.

14. The method according to claim 1, wherein a length in a longitudinal direction of the flow channel is 40 cm or less.

15. The method according to claim 1, wherein an inner diameter of the flow channel is 10 mm or less.

16. The method according to claim 1, wherein a volume of the flow channel is 2000 μl or less.

17. The method according to claim 1, wherein the ratio of non-labeled particles to labeled particles in the suspension is 0.09% or less and 0.01% or more.

18. The method according claim 1, wherein the labeled particles comprise magnetic beads of 1 μm or less.

* * * * *